US009919768B1

(12) United States Patent
Brookins

(10) Patent No.: US 9,919,768 B1
(45) Date of Patent: Mar. 20, 2018

(54) POWER CLEAT SYSTEM

(71) Applicant: Keith Donald Brookins, Miami, FL (US)

(72) Inventor: Keith Donald Brookins, Miami, FL (US)

( * ) Notice: Subject to any disclaimer, the term of this patent is extended or adjusted under 35 U.S.C. 154(b) by 0 days.

(21) Appl. No.: 15/428,838

(22) Filed: Feb. 9, 2017

(51) Int. Cl.
*B63B 21/04* (2006.01)
*B63B 21/00* (2006.01)

(52) U.S. Cl.
CPC ..... *B63B 21/04* (2013.01); *B63B 21/00* (2013.01)

(58) Field of Classification Search
CPC ..... B63B 21/00; B63B 21/04; B63B 21/08
USPC ..... 114/218, 230.11
See application file for complete search history.

(56) References Cited

U.S. PATENT DOCUMENTS 4,809,634 A * 3/1989 Czipri ..... B63B 21/045 114/218
7,131,387 B1 * 11/2006 Czipri ..... B63B 21/045 114/218
8,025,431 B1 * 9/2011 Burke ..... B63B 21/045 114/218
8,033,233 B2 * 10/2011 Strong ..... B63B 21/04 114/218

* cited by examiner

*Primary Examiner* — Lars A Olson
(74) *Attorney, Agent, or Firm* — Albert Bordas, P.A.

(57) ABSTRACT

A power cleat system having a cleat assembly, a cleat base assembly, a backer plate assembly, a guide assembly, and an actuating system to elevate and retract the cleat assembly from the cleat base assembly. The cleat assembly has a top end, a base, and guide shafts. The guide shafts have flat sides and ends. The cleat base assembly has a drain groove, a base, threaded sections protruding from the base, and linear bearings. The backer plate assembly has a backer plate, backer plate holes, and a backer plate housing hole. The actuating system has a bladder assembly, which includes a bladder cradle, a coupler bolt, a base with a hole, and a fill/discharge stem. The power cleat system further has a bezel gasket assembly, and an electrical assembly that has a light source to illuminate the cleat assembly and/or the cleat base assembly.

19 Claims, 5 Drawing Sheets

POWER CLEAT SYSTEM

II. BACKGROUND OF THE INVENTION

1. Field of the Invention

The present invention relates to sea vessel and marina cleats, and more particularly, to power cleat systems.

2. Description of the Related Art

Applicant is not aware of any power cleat system having the novel features of the present invention.

III. SUMMARY OF THE INVENTION

The present invention is a power cleat system comprising a cleat assembly, a cleat base assembly, a backer plate assembly, a guide assembly, and an actuating system to actuate the cleat assembly.

The cleat assembly comprises a top end, a base, and guide shafts. The guide shafts each comprise a flat side and an end. The cleat base assembly comprises a drain groove, a base, and threaded sections protruding from the base. In addition, the cleat base assembly comprises linear bearings. The power cleat system further has a bezel gasket assembly that comprises a gasket and a hole. The backer plate assembly comprises a backer plate, backer plate holes, and a backer plate housing hole. The guide assembly comprises a guide assembly plate.

The actuating system elevates and retracts the cleat assembly from the cleat base assembly, whereby springs retract the cleat assembly onto the cleat base assembly. The actuating system comprises a bladder assembly, which has a bladder cradle, a coupler bolt and a base with a hole. The bladder assembly comprises a bladder to elevate the cleat assembly from the cleat base assembly. The bladder assembly further comprises a fill/discharge stem. The power cleat system further comprises an electrical assembly that has a light source to illuminate the cleat assembly and/or the cleat base assembly.

It is therefore one of the main objects of the present invention to provide a power cleat system.

It is another object of this invention to provide a power cleat system designed for docks and vessels that present as a low profile cleat or group of cleats that can be remotely actuated, causing them to raise, an elevated position, and present as cleats ready for use.

It is another object of this invention to provide a power cleat system comprising a cleat assembly that defaults to a down, also defined as retracted, position and can be manually lifted for use if needed.

It is another object of this invention to provide a power cleat system designed to retract on demand or with a timeout feature.

It is another object of this invention to provide a power cleat system designed to reduce risks as a trip or snag hazard.

It is another object of this invention to provide a power cleat system designed with safety, style, and alignment by a location revealing light.

It is another object of this invention to provide a power cleat system designed to shed water rather than pool it.

It is another object of this invention to provide a power cleat system that is lighted by an electrical assembly.

It is another object of this invention to provide a power cleat system with an electrical assembly, which further gives style to the general appearance of the system.

It is another object of this invention to provide a power cleat system that is raised and lowered remotely.

It is another object of this invention to provide a power cleat system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
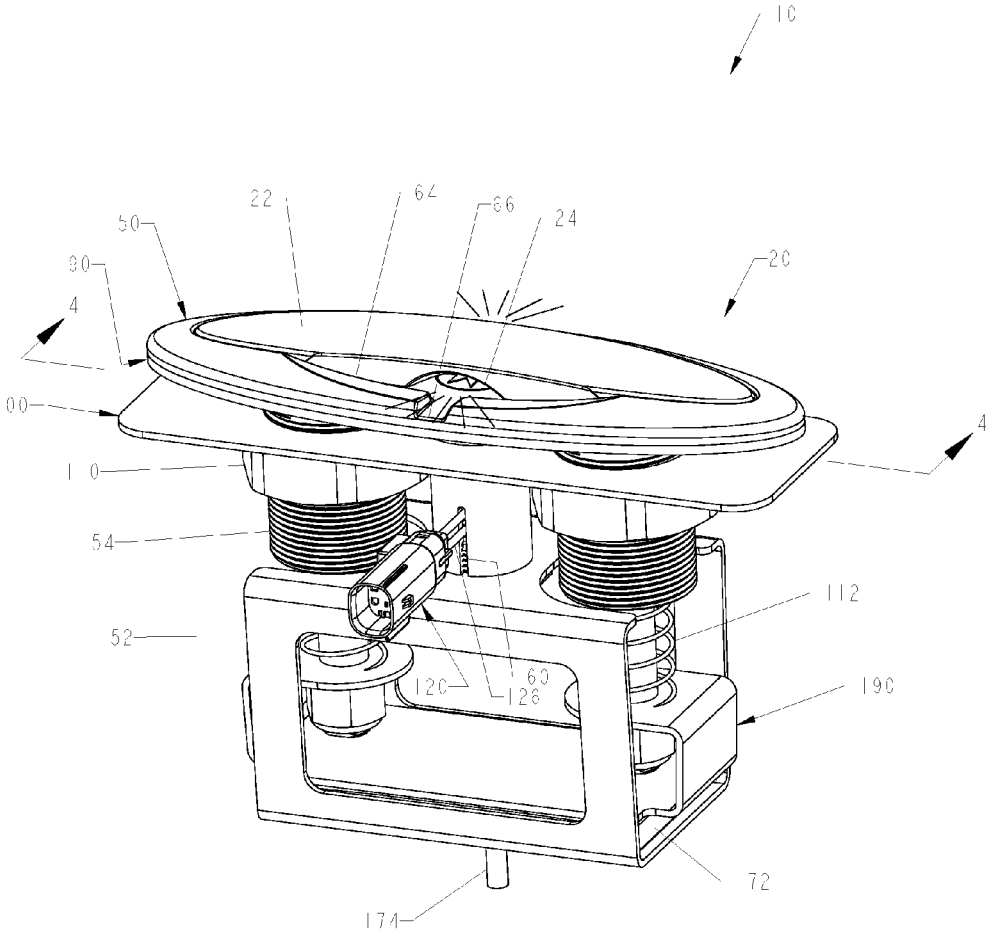
FIG. 1 represents an isometric view of the present invention in a retracted configuration.

Referring now to the drawings, the present invention is a power cleat system and is generally referred to with numeral 10. It can be observed that it basically includes cleat assembly 20, cleat base assembly 50, backer plate assembly 100, guide assembly 190, and an actuating system to actuate cleat assembly 20.

Figure 2:
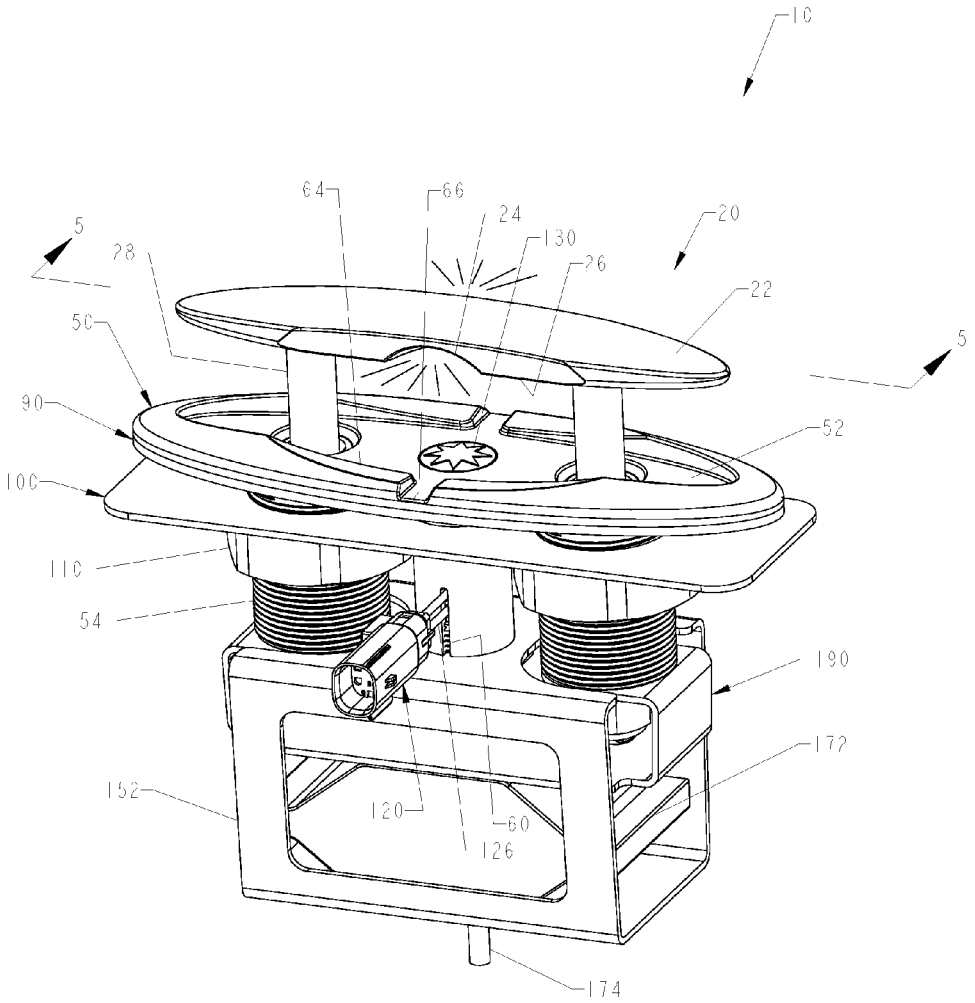
FIG. 2 represents an isometric view of the present invention in an extracted configuration.

As seen in FIGS. 1 and 2, present invention 10 is a cleat system designed for docks and vessels that present as a low profile cleat or group of cleats that can be remotely actuated, causing them to raise, an elevated position, and present as cleats ready for use. Present invention 10 can be made of marine grade stainless steel and is designed to take up a small amount of space, fitting easily inside gunnels and bows of vessels or the deck of a dock.

Present invention 10 therefore comprises cleat assembly 20, which can be elevated from or retracted onto cleat base assembly 50.

Once mounted onto docks or vessels, not seen, bezel gasket assembly 90, backer plate assembly 100, guide assembly 190, and electrical assembly 120 are coupled and positioned below cleat base assembly 50 and mounted for bladder cradle 152. More specifically, once mounted onto docks or vessels, not seen, electrical assembly 120 assembles inside electrical housing 58, and fastened by light assembly nut 124, while bladder cradle 152 is fastened below electrical housing 58, by coupler bolt 154. In a preferred embodiment, electrical assembly 120 relates to illuminations means.

Cleat assembly 20 defaults to a down, also defined as retracted, position and can be manually lifted for use if needed. Furthermore, designed to retract on demand or with a timeout feature, cleat assembly 20 returns to its low profile. In the down, also defined as retracted, position the low profile of cleat assembly 20 presents reduced risks as a trip or snag hazard.

Figure 3:
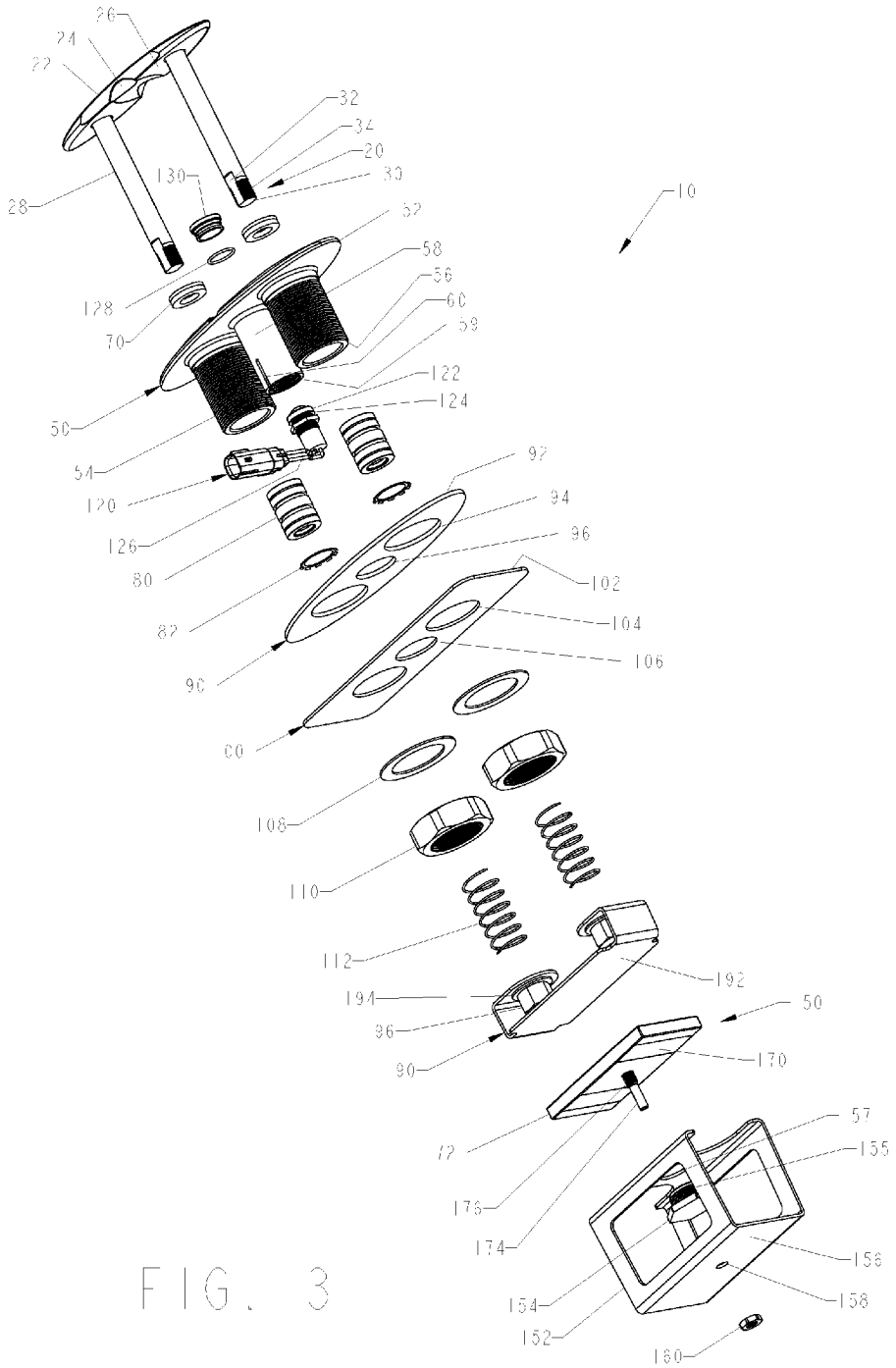
FIG. 3 is an exploded view of the present invention.

Cleat assembly 20 and/or cleat base assembly 50 are lighted by electrical assembly 120 and light source 122, seen in FIG. 3. In a preferred embodiment, light source 122 is a light-emitting diode (LED) module or a bulb. When switched "on" by an operator, light source 122 illuminates whether cleat assembly 20 is in the down, also defined as retracted, position, or in the up, also defined as elevated position. Light source 122 further illuminates a cleat assembly 20 location for safety and docking convenience, and also as it relates to a trip hazard. In addition, light source 122 provides distinguished looks and style to power cleat system 10. Lens 130 is able to present a custom logo, boat name, symbol, numbers, and/or letters. Light source 122 allows for colors to be selectable and to be dimmable. Vessel mounted cleat assemblies 20 will illuminate and indicate their perpendicular location onto the dock, not seen. Conversely, dock mounted cleat assemblies 20 will illuminate and indicate their perpendicular location onto the vessel, adding in ranging a particular cleat assembly 20 to its desired tie-off location, not seen.

In addition, as seen in FIG. 2, cleat base assembly 50 has scallop cuts 64, and drain grooves 66 for water drainage from cleat base assembly 50 and allow for a light channel by which light may be directed outward while cleat assembly 20 is in the down position. Cleat base assembly 50 is designed to shed water rather than pool it.

As seen in FIG. 3, present invention 10 comprises cleat assembly 20, cleat base assembly 50, backer plate assembly 100, bladder cradle 152, guide assembly 190, and an actuating system to actuate cleat assembly 20.

Cleat assembly 20 comprises top end 22, notch 24, base 26, and guide shafts 28. Guide shafts 28 comprise first and second ends 30, flat sides 32, and threaded sections 34 respectively. The formation of each guide shaft 28 and its respective flat side 32 forms a "D" shape. In an embodiment, notch 24 is reflective.

Cleat base assembly 50 comprises base 52, electrical housing 58 comprising slit 60, and protruding from base 52 are threaded sections 54 having respective ends 56. In addition, cleat base assembly 50 comprises shaft seals 70, linear bearings 80 and retaining rings 82 that are all housed within threaded sections 54. It is noted that electrical housing 58 is both, a housing for electrical assembly 120 and a mount for bladder cradle 152.

Power cleat system 10 may comprise bezel gasket assembly 90 comprising gasket 92, hole 94, and housing hole 96. Backer plate assembly 100 comprises backer plate 102, backer plate holes 104, and backer plate housing hole 106. Backer plate assembly 100 and bezel gasket assembly 90 are coupled to cleat base assembly 50 with washers 108 and nuts 110. Guide assembly 190 comprises guide assembly plate 192, washers 194, and nuts 196.

The actuating system elevates and retracts cleat assembly 20 from cleat base assembly 50. In a preferred embodiment, the actuating system comprises bladder assembly 150, which comprises bladder cradle 152, coupler bolt 154, and base 156 having hole 158.

Bladder assembly 150 comprises bladder bottom 170, bladder 172, and fill/discharge stem 174 having threaded section 176. Gas or fluid is introduced or extracted through fill/discharge stem 174 to inflate and deflate bladder 172. Bladder 172, by being inflated, elevates cleat assembly 20 from cleat base assembly 50. As bladder 172 deflates, springs 112 expand to bias cleat assembly 20 onto cleat base assembly 50.

Power cleat system 10 further comprises electrical assembly 120 that has light source 122 to illuminate cleat assembly 20 and/or cleat base assembly 50. Electrical assembly 120 further comprises light assembly nut 124, wire leads 126, lens o-ring 128 and lens 130. Safety and style of power cleat system 10 is enhanced by location revealing light illuminating from light source 122 of electrical assembly 120. Therefore, power cleat assembly 10, comprising electrical assembly 120, is also designed to reveal its location to further reduce trip hazard. When switched "on" by an operator, light source 122 is designed to be visible regardless of cleat assembly 20 being up or down. In any position, the underside of cleat assembly 20 is designed to split the light source to sides, through drain grooves 66 to illuminate the area perpendicular to that cleat assembly 20 providing accurate and easy alignment from afar. Furthermore, vessel location is achieved by splitting the up light from light source 122, as an example 90 degrees, throwing a locating beam of light which illuminates an area parallel to the vessel and allowing a vessel operator to stop adjacent to where the vessel will be tied.

When assembled, guide assembly 190 is positioned onto bladder 172, and both guide assembly 190 and bladder 172 with its bladder bottom 170 are all positioned within bladder cradle 152, whereby fill/discharge stem 174 protrudes through hole 158 and nut 160 fastens onto threaded section 176. It is noted that exterior threads 155 of coupler bolt 154 fasten onto interior threads 59 of electrical housing 58, whereby bladder cradle 152 has hole 157 to accommodate coupler bolt 154. Therefore, electrical housing 58 is both, a housing for electrical assembly 120 and a mount for bladder cradle 152.

Figure 4:
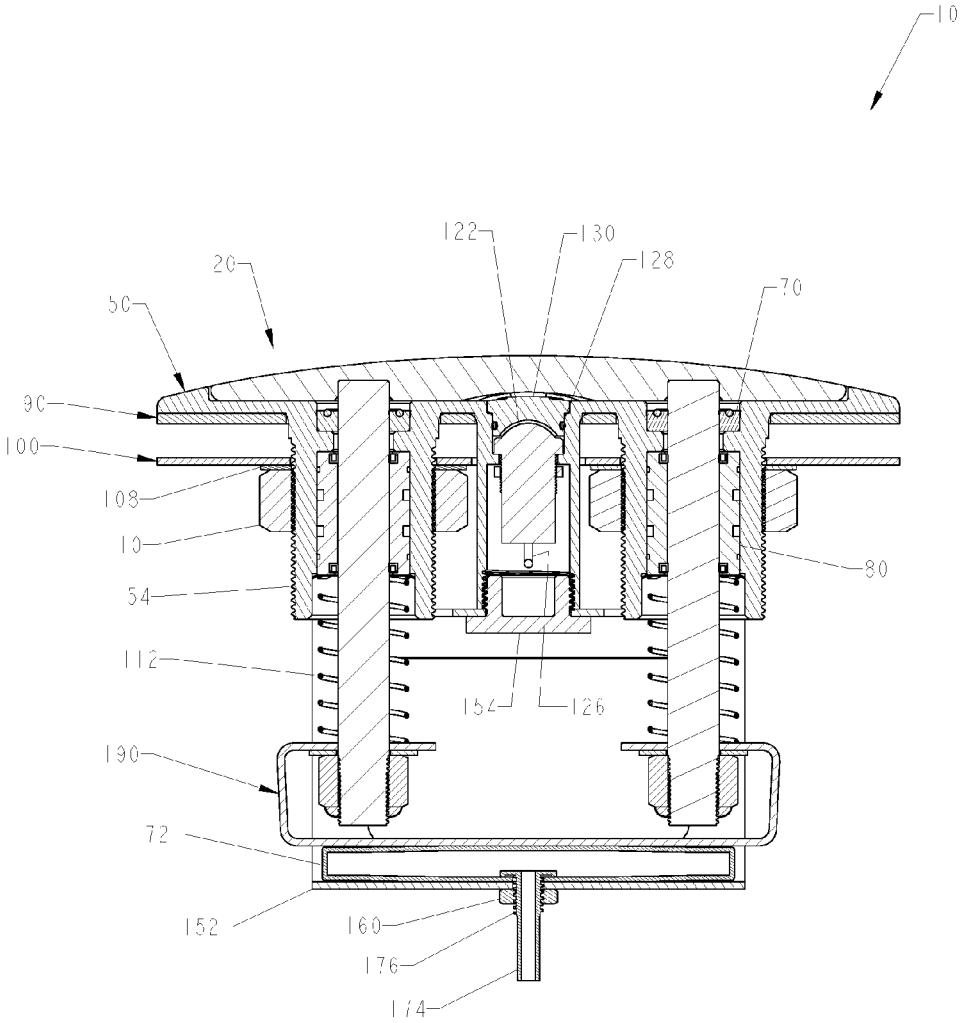
FIG. 4 is a cut view taken along the lines 4-4 as seen in FIG. 2.

As seen in FIG. 4, as the default position, springs 112 comprise a spring force to keep cleat assembly 20 in the down, also defined as retracted, position. This assures that cleat assembly 20 is quiet and not clanky while under way.

Figure 5:
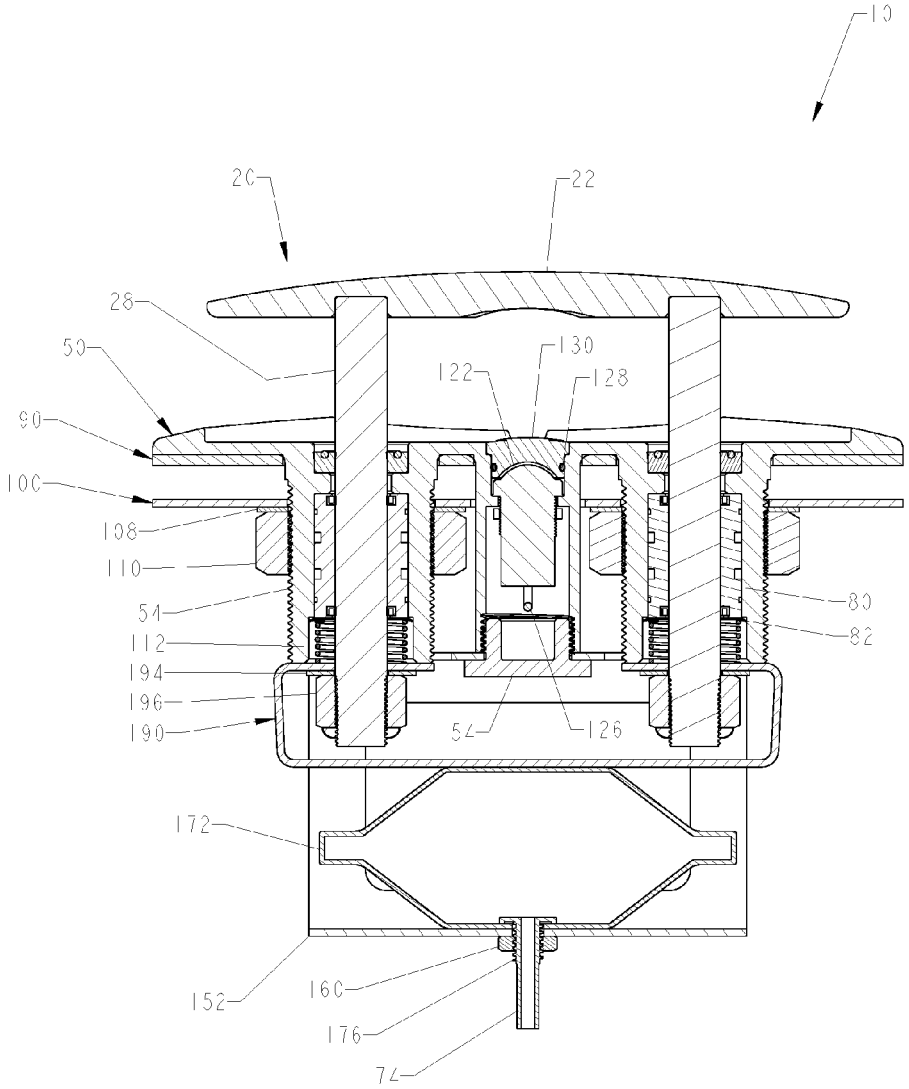
FIG. 5 is a cut view taken along the lines 5-5 as seen in FIG. 2.

As seen in FIGS. 4 and 5, shaft seals 70 and bezel gasket assembly 90, and lens o-ring 128 prevent water from leaking through present invention 10. Fill/discharge stem 174 is machined internal of bladder 172 to reach out to a wide radius and bring a sealing force down to bladder bottom 170 by nut 160 tension. Nut 160 holds bladder 172 down and prevents rotation and migration as well.

In operation, present invention 10 is a power cleat system, a pop up style cleat that is raised and lowered remotely. Present invention 10 can be remotely controlled from a single act of a user. Present invention 10 is designed to be stronger than conventional cleats of a same size due to a lack of detent notching in its guide shafts 28. Cleat assembly 20 and cleat base assembly 50 are low profile in the down, also defined as retracted and default, position and work at any angle or orientation. As an example, present invention 10 may be side mounted onto a pier or dock.

Present invention 10 further comprises means to adjust speeds to retract cleat assembly 20 onto cleat base assembly 50, and to elevate cleat assembly 20 from cleat base assembly 50. Actuation speed of up and down is controlled by controlling working pressures by means of restriction to fill rate during extension and restriction of discharge rate during retraction. An option exists to time out the up position to return to the default position by allowing a small weep of pressurized system, allowing it to eventually always return to the safe, default position even if an operator forgets to put down.

Furthermore, although not illustrated, it is understood that the actuating system can be activated by gas or fluid. The actuating system can work safely at very low pressures such as 10 psi, as an example, and can be set to move fast, snapping to attention, or slow for quiet repositioning. The actuating system can be controlled manually by keychain radio frequency (RF) remote. Manual control can activate the actuating system by a button, lever, push pull, or any number of valve configurations including a switch located somewhere in the vessel, not seen, presumably the helm, where it is easily accessed. The manual control can operate all cleat assemblies 20 and can provide control to individual cleat assembly 20 groups by adding a dedicated switch. One such example is by separately controlling the port and starboard sides. A control button may be, as an example, a toggle or push-pull. The toggle is pulled to the up position to lift cleat assemblies 20 and pushed down to lower cleat assemblies 20, while push-pull is configured to pull out to raise cleat assemblies 20 and depress to lower cleat assemblies 20.

Present invention 10 is therefore watertight, lighted, powered, remotely actuated, strong, works at any angle/orientation, has means for speed control, it's actuating means may use an open or closed, air or hydraulic loop, and is quiet.

Present invention 10 can replace pull up cleats, providing ease, comfort and speed to the process or lifting and lowering cleats around the vessel without having to walk the perimeter of the vessel performing rack act individually. Saving time, saving effort, and providing further safety by allowing an operator to stay in the safety of the helm while performing this task.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A power cleat system, comprising:

A) a cleat assembly;

B) a cleat base assembly;

C) a backer plate assembly;

D) a guide assembly;

E) an actuating system to actuate said cleat assembly; and

F) a bezel gasket assembly.

2. The power cleat system set forth in claim 1, further characterized in that said actuating system elevates said cleat assembly from said cleat base assembly.

3. The power cleat system set forth in claim 1, further characterized in that said actuating system retracts said cleat assembly onto said cleat base assembly.

4. The power cleat system set forth in claim 1, further characterized in that said cleat assembly comprises a top end and a base.

5. The power cleat system set forth in claim 1, further characterized in that said cleat assembly comprises guide shafts.

6. The power cleat system set forth in claim 5, further characterized in that each of said guide shafts comprises first and second ends.

7. The power cleat system set forth in claim 5, further characterized in that each of said guide shafts comprises a flat side.

8. The power cleat system set forth in claim 1, further characterized in that said cleat base assembly comprises a drain groove, a base, and threaded sections protruding from said base.

9. The power cleat system set forth in claim 1, further comprising linear bearings.

10. The power cleat system set forth in claim 1, further characterized in that said actuating system comprises springs to retract said cleat assembly onto said cleat base assembly.

11. The power cleat system set forth in claim 1, further characterized in that said backer plate assembly comprises a backer plate, backer plate holes, and a backer plate housing hole.

12. The power cleat system set forth in claim 1, further characterized in that said guide assembly comprises a guide assembly plate.

13. The power cleat system set forth in claim 1, further characterized in that said actuating system comprises a bladder assembly.

14. The power cleat system set forth in claim 13, further characterized in that said bladder assembly comprises a bladder cradle and a coupler bolt.

15. The power cleat system set forth in claim 13, further characterized in that said bladder assembly comprises a base with a hole.

16. The power cleat system set forth in claim 13, further characterized in that said bladder assembly comprises a bladder to elevate said cleat assembly from said cleat base assembly.

17. The power cleat system set forth in claim 13, further characterized in that said bladder assembly comprises a fill/discharge stem.

18. The power cleat system set forth in claim 1, further comprising an electrical assembly.

19. The power cleat system set forth in claim 18, further characterized in that said electrical assembly comprises a light source to illuminate said cleat assembly and/or said cleat base assembly as it relates to a trip hazard.

* * * * *